United States Patent [19]

Ginatta

[11] 4,400,247

[45] Aug. 23, 1983

[54] METHOD OF PRODUCING METALS BY CATHODIC DISSOLUTION OF THEIR COMPOUNDS

[75] Inventor: Marco V. Ginatta, Turin, Italy

[73] Assignee: Metals Technology & Instrumentation, Inc., Dallas, Tex.

[21] Appl. No.: 261,336

[22] Filed: May 7, 1981

[30] Foreign Application Priority Data

May 7, 1980 [IT] Italy ..... 67706 A/80
Apr. 15, 1981 [IT] Italy ..... 67519 A/81

[51] Int. Cl.[3] ..... C25C 1/00; C25C 1/02; C25C 1/06; C25C 1/12

[52] U.S. Cl. ..... 204/59 M; 204/60; 204/61; 204/64 R; 204/64 T; 204/65; 204/66; 204/67; 204/105 R; 204/105 M; 204/106; 204/107; 204/108; 204/112; 204/114; 204/115; 204/120; 204/124; 204/128; 204/243 R; 204/243 M; 204/244; 204/250; 204/268

[58] Field of Search ..... 204/254–256, 204/105 R, 39, 60–61, 219, 243 R, 250, 128, 106–108, 112–122, 105 M, 64 R, 64 T, 65–67, 59 M, 124, 243 M, 244, 268

[56] References Cited

U.S. PATENT DOCUMENTS 883,170 3/1908 Christy ..... 204/268
3,657,098 4/1972 Raetzsch ..... 204/219

*Primary Examiner*—R. L. Andrews
*Attorney, Agent, or Firm*—Edwin E. Greigg

[57] ABSTRACT

Metals and metalloids are produced by cathodically dissolving compounds thereof in electrolytic cells. These cells have one or more heterogenous bipolar electrodes in series, with a terminal electrode as cathode and another terminal electrode as a soluble or inert anode. A common electrolyte is in contact with all electrodes.

The compounds of the metals or metalloids are introduced into the cells and are brought into contact with the cathodic sides of the heterogenous electrodes. A cathodic half reaction takes place on the heterogenous bipolar electrode which permits the reduction and dissolution of the metal and metalloid compounds into the common electrolyte. The terminal negative electrodes are the site of the electrolytic deposition of the metals.

The cells may also include an electrowinning system of anodes and cathodes, connected by way of the common electrolyte, for depositing the dissolved metals.

24 Claims, 14 Drawing Figures

METHOD OF PRODUCING METALS BY CATHODIC DISSOLUTION OF THEIR COMPOUNDS

BACKGROUND OF THE INVENTION

This invention concerns the production of metals and metalloids by means of dissolving cathodically their compounds in electrolytic cells comprising a series of heterogeneous bipolar electrodes.

The production of non-ferrous metals in general and of the so-called reactive metals in particular, is presently obtained by means of:

(a) discontinuous chemical processes;

(b) electrowinning cells having insoluble electrodes; and (c) anodic dissolution of compounds and cathodic deposition of metals.

Discontinuous chemical processes are labor intensive and do not produce metals with purity as for the specifications presently required.

The use of traditional electrolytic cells is restricted to metal compounds which have a sufficient solubility in the electrolyte.

Anodic dissolution of metal compounds usually results in low yields which are unacceptable for industrial plant processes.

The operation of cells having a terminal cathode onto which the metal is deposited and a terminal insoluble anode is known to those skilled in the art.

The electrowinning practice of using a pair of electrodes with cathodes and insoluble anodes in order to lower the metal concentration in the electrolytes, is also known.

SUMMARY OF THE INVENTION

An object of the present invention is a method which allows the production of high purity metals, using electrolytes in which the metal compounds, that are the starting raw materials, have low solubility or are insoluble.

Another object of the invention is a method based on the cathodic dissolution of the compound of the metal to be produced.

Said objects can be achieved, according to this invention, by the use of an electrolytic cell comprising a series of heterogeneous bipolar electrodes, and a first terminal electrode used as a cathode with the other terminal electrode used as an inert or soluble anode and this electrolytic cell can be linked together, or not, to an electro winning cell having cathodes and insoluble anodes.

The use of the electrochemical mechanism of this invention, for producing any metal or metalloid by operating with heterogeneous bipolar electrodes, has never been proposed before: thus, the cathodic dissolution of metal compounds simultaneously but separately from the cathodic dissolution of the metals has never been possible in the past.

One of the main characteristics of the electrochemical system in series, comprising heterogeneous bipolar electrodes suitable for the production of metals and metalloids, which is an object of this invention, is the fact that applicant can obtain the electrochemical dissolution, with high current efficiency, of compounds, including reactive metal compounds which generally have low solubility when only chemically attacked.

The heterogeneous bipolar electrode is defined as any electronic conductor of any form, having a portion of its surface, which is immersed in an electrolyte, being the site of an electrochemical half-reaction which is not only opposite, but also different from the electrochemical half-reaction which occurs on another portion of the bipolar electrode surface.

As for an example, it can be seen that, while on a first solid electrode side (front), which is vertically immersed in an electrolyte, the anodic dissolution (oxidation) of a metal occurs; on the second side (back), the reduction of a compound of the metal to be produced is taking place; this metal on the second side can be different from that which dissolves at the first side (front) of the bipolar electrode. The first side metal will be called the metal different from that deposited.

It is also possible that, instead of an anodic dissolution of a metal, on the first side an oxidation and gas evolution can occur.

It is also possible that the metal compound reduction be only partial, that is, for example, the reduction of an higher oxide (dioxide) to a lower oxide (monoxide): in this case, an electrolyte will be chosen which can attack, with chemical reaction, the lower valence compound just formed on the electrode surface.

From one to any number of heterogenous bipolar electrodes can be positioned in series with suitable distance between them.

The circuit of the electrochemical system in series can be completed by introducing a positive terminal electrode, soluble or insoluble, i.e., being the site of gas evolution or metal dissolution.

The negative terminal electrode may receive the electrodeposition of the metal, coming from the compound (for instance, the oxide) which has been solubilized at the negative sides of the heterogeneous bipolar electrodes. The negative terminal electrode may facilitate, also itself, the cathodic dissolution of the compound of the metal to be produced.

Working with suitably shaped bipolar electrodes, it is unnecessary that the negative terminal electrode be positioned in linear series with all other electrodes.

With the mechanism above indicated applicant obtains the dissolution of a larger quantity of the metal compound, as regards this quantity of the metal which will deposit on the negative terminal electrode.

It is necessary, therefore, to introduce into the electrolytic cell an electrowinning system, consisting of one cathode, onto which metals dissolved in excess can be deposited, and one anode, preferably insoluble, onto which an oxidation reaction can take place.

The electrowinning system may also be installed in cells which are separate from the cells containing the heterogeneous bipolar electrodes, provided that there is an exchange or circulation of electrolyte between the two types of cells.

The electrowinning cells may be connected with another direct current power source, in order to be independently controlled from the current supply used by the cells containing the heterogeneous bipolar electrodes.

DESCRIPTION OF THE INVENTION

From here-on the heterogeneous bipolar electrodes will also be indicated with the acronym HBE.

Figure 1:
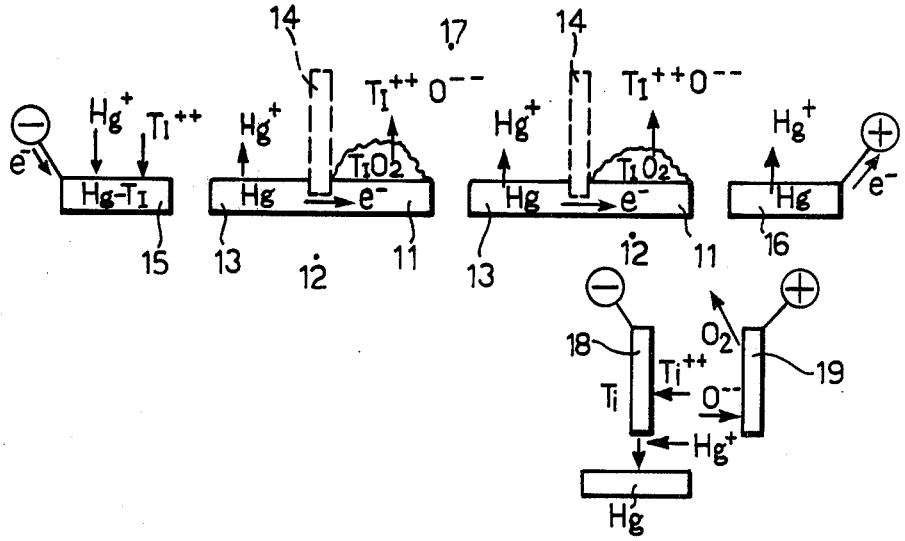
FIG. 1 is a schematic view of an embodiment of the invention for the electrodissolution and for the electrowinning of titanium from titanium dioxide on mercury.

In the schematic view of FIG. 1, which illustrates the electrowinning of titanium on mercury, the metal compound, titanium dioxide, is continually introduced into the cell and brought in contact with the cathodic sides 11 of the HBE 12.

The cathodic half reaction is the dioxide reduction to lower oxide, monoxide for example, according to the reaction:

$$TiO_2+2e^-=TiO+O^{--}$$

using up the electron set free and coming from the anodic sides 13 of the HBE on which the other half reaction occurs.

The two parts of the HBE are divided by the wall 14.

The electrolyte CA 17 reacts with the monoxide through a chemical reaction producing a metal compound which is soluble in the electrolyte itself, according to a reaction of the type:

$$TiO+2CA=TiA_2+C_2O$$

The half reaction occurring on the anodic sides 13 of the HBE 12 may be any oxidation which is compatible with the species which are present in the electrolyte.

For example, the oxidation of an amount of the metal which was previously produced can be made to occur according to the reaction:

$$Ti=Ti^{++}+2e^-$$

or of another metal (different from that produced) according to the reaction of the type:

$$Me=Me^{++}+2e^{31}.$$

The different from that produced metal, which in this case is mercury, is codeposited on the terminal cathode 15, together with the metal to be produced, and separated from it. The soluble anode 16 comprises mercury.

A couple of electrodes, the cathode 18 and the insoluble anode 19 is used for the electrowinning of metals dissolved in excess by the HBE 12.

On the electrowinning cathode 18 metals are deposited, in a rate permitting the maintenance of steady-state electrolytic operations.

Figure 2:
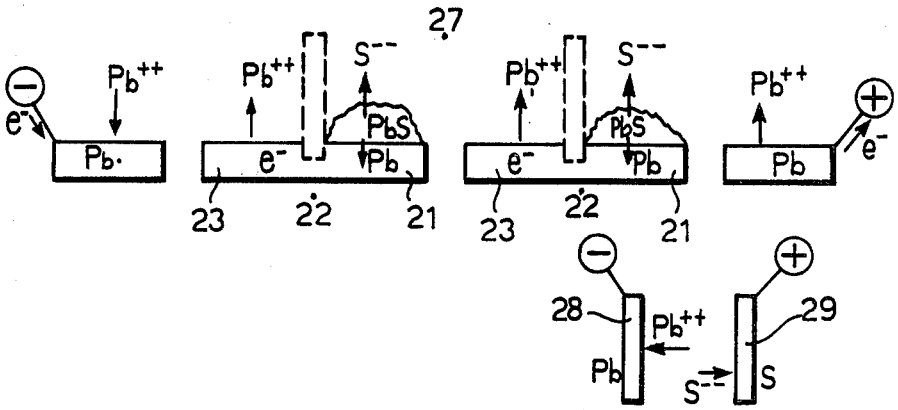
FIG. 2 is a schematic view of an embodiment of the invention for the electrowinning of lead from sulphides.

For a better illustration of the embodiment of the invention for the production of non ferrous metals, the schematic view of FIG. 2 depicts the electrowinning of lead.

The metal compound, i.e. lead sulphide, (PbS) is continually introduced into the cell and brought into contact with the cathodic parts 21 of the HBE 22.

On the anodic part 23, metallic lead is continually dissolved. Also the HBE 22 may be of lead itself in the molten state comprising both the anodic and cathodic portions of lead.

The electrolyte 27 may be an aqueous solution (autoclave) or molten salt which forms soluble lead compounds. In this case, the reduction of the compound containing the metal to be produced does not occur, instead the solubilization, electrochemically forced, of the compound is actuated, with fast dissolution kinetics. This is one object of the invention.

A pair of electrodes, cathode 28 of lead and insoluble anode 29 of sulphur, is used for the electrowinning of the metal and of elemental sulphur.

In general, at the electrowinning anode 29 is produced the element (or compound) which originally was part of the raw material containing the metal to be produced.

In the case of working with metal oxides, oxygen evolution will occur; at the anode in the case of chlorides, chlorine; sulphides, sulphur and analogously for other compounds.

By choosing a suitable metal different from that produced, it is possible to obtain the metal to be produced by fractional crystallization.

Working with molten salt-based electrolytes, or their mixtures, it is helpful to use, as HBE electrode metal, a low melting point metal; this metal, in liquid state, permits an horizontal geometrical configuration for the HBE itself.

The density of the metal forming the electrode determines the cell geometry with electrodes at the bottom or at the surface.

Examples of metals useful for the HBE anode and cathode portions are the alkaline and alkaline-earth metals Li, Na, K, Mg, Ca, Sr, Ba, and the low melting point metals of the groups IIB: Zn, Cd, Hg; IIIA: Al, Ga, In, Tl; IVA: Sn, Pb; Va: Sb, Bi.

The aforesaid horizontal configuration is advantageously applied with aqueous or non aqueous solutions using amalgams or mercury alloys, as the metal for the heterogeneous bipolar electrodes.

When, on the contrary, an HBE electrode metal which is solid at the process conditions, is to be used, it is possible to secure the electrical connection with the metal compound, by making the HBE by means of spreading and pressing this compound, as a paste, onto a grid structure, made with the HBE electrode metal.

It is useful for the described electrochemical system to use a controlled atmosphere; and particularly, when reactive metals are produced, it is necessary that an inert gas, e.g. Argon or Helium, be present over the electrolyte; furthermore it is beneficial to use a gas having reducing characteristics, e.g. hydrogen.

It is also useful that the anodic reaction which occurs on the positive terminal electrode, on the anodic sides of HBE, and on the anode of the electrowinning system, if this reaction is a gaseous evolution, be facilitated by maintaining, over the electrolyte, a pressure lower than the atmospheric and in particular between 10 and 200 mmHg.

As electrolytes, it is possible to use a large number of solutions whose essential characterists are to have a solubility for the metal compound these soluble metal compounds are produced by the reactions at the HBE or are soluble with the electrolyte itself.

For instance, some of the solutions may be fluoboric acid, sulphamic and methyl sulphonic acid, either alone or in a mixture, either as anhydrous molten salts or in acqueous solutions; the organic solvents: acetonitrile, butyrolactone, dimethyl formamide, dimethyisulfoxide, ethylene carbonate, ethyl ether, methyl formate, nitromethane, propylene carbonate, tetrabutyl ammonium iodide.

As electrolytes, based on molten salts, the following chorides and fluorides of alcaline metals and alkaline earth may be used: Li, Na, K, Rb, Cs, Mg, Ca, Sr, Ba, either pure or in mixtures having a melting point not higher than 825° C. Some of the electrolytic baths used are listed in Tables I-II-III, together with the average temperature at which the electrolysis was carried out.

TABLE 1

| LiCl % | NaCl % | KCl % | CsCl % | $MgCl_2$ % | $CaCl_2$ % | $SrCl_2$ % | $BaCl_2$ % | T °C. |
|---|---|---|---|---|---|---|---|---|
| | 100 | | | | | | | 800 |
| 55–60 | | 45–40 | | | | | | 475–575 |
| | 27–98 | | | | | 73–2 | | 650–800 |
| | 66 | | | 34 | | | | 750 |
| | 85–98 | | | | | | 15–2 | 750–800 |
| | 30–50 | | | | 70–50 | | | 700–750 |
| | 50 | 50 | | | | | | 750 |
| | | 54 | | | | | 46 | 825 |
| | | | | 40 | 60 | | | 825 |
| | | 67 | | | 33 | | | 700 |
| | 37 | | | | 47 | | 16 | 540 |
| | 24 | 41 | | | | | 35 | 650 |
| 40–70 | 0–20 | 25–55 | | | | | | 450–600 |
| | 20 | 20 | | | 60 | | | 725 |
| | 45 | 5 | | 23 | 11 | | 16 | 550 |
| | | | 100 | | | | | 750 |
| | | 52 | 48 | | | | | 730 |

TABLE II

| LiF % | NaF % | KF % | $MgF_2$ % | $CaF_2$ % | $SrF_2$ % | $BaF_2$ % | T °C. |
|---|---|---|---|---|---|---|---|
| 46,5 | 11,5 | 42,0 | | | | | 650 |
| 52 | | 48 | | | | | 700 |
| 50 | 50 | | | | | | 725 |
| 36 | 39 | | 2 | 23 | | | 570 |
| 45 | 10 | 40 | | | 5 | | 670 |
| 47 | 46 | | | | | 7 | 730 |

TABLE III

| LiCl % | NaCl % | KCl % | CsCl % | LiF % | NaF % | KF % | CsF % | T °C. |
|---|---|---|---|---|---|---|---|---|
| | 97 | | | | | 3 | | 800 |
| 39 | 5 | 51. | | | | 5 | | 780 |
| | | 50 | | | | 50 | | 750 |
| | | | 72 | | | | 28 | 700 |
| | | | 91 | | | 9 | | 725 |
| | 8 | | | 46 | 46 | | | 750 |
| | 35 | 47 | 14 | | | 4 | | 715 |

For the production of the reactive metals, titanium dioxide and tetrachloride, zirconium dioxide and tetrachloride are useful and are very stable substances in a large number of conditions; according to the invention, the electrochemical reduction of the compound is carried out, using at the same time the characteristics of chemical attack of the electrolyte; this is one of the advantages of the so-devised HBE series system, because it permits the cathodic dissolution of the compounds on the cathodic sides of the HBE and, at the same time, the winning of the deposit on the terminal cathode, and on the cathodes of the electrowinning system.

As shown in the examples which follow, by using as the raw material, titanium tetrachloride, applicant has produced, according to this invention, a titanium metal of high purity, over 99.9% with low oxygen content, less than 200 ppm, in a continuous process with high energy efficiency.

In the cases of metals which produce dendritic deposits, it may be advantageous to use a terminal cathode with a surface much larger (about 10 times) than that of the HBE, in order to have low current densities.

Furthermore, the use of power supplies delivering pulsating direct current, promotes the formation of solid cathodes with very low salt drag-out.

Power supplies delivering periodic reversed current with cyclic dead time promote the production of smooth deposits.

Both HBE cells and winning cells may be connected to the same d-c power supplies. However, it was found to be important for practical utilization, that the supply of direct current to the HBE cell be separated from the supply of d-c to the metal winning electrodes. For this reason, it is preferable to use two different rectifiers.

One very important exploitation of the present invention is the direct dissolution of metallic ores, and contemporaneous electrowinning of the pure metals.

Particularly, oxide, sulphates, sulphides, chlorides, fluorides, have been treated and the respective metals produced.

By means of this invention, it is possible to obtain a continuous production of the metal from its compounds, with high purity of the metal produced.

The industrial plant used for said production is easily automated.

DESCRIPTION OF THE PREFERRED EMBODIMENTS

Figure 3:
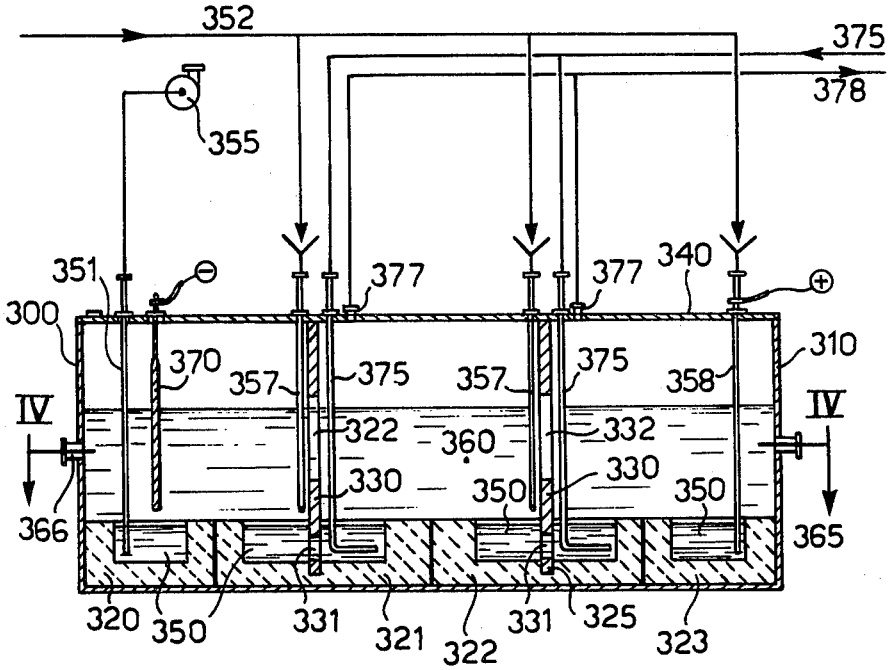
FIG. 3 is a cross-sectional view along the III—III line of FIG. 4, of an electrolytic cell in which, according to the present invention, the cathodic dissolution of a compound, liquid or gaseous, using a liquid metal with density higher than that of the electrolyte, occurs, simultaneously with the electrowinning of the metal.
Figure 4:
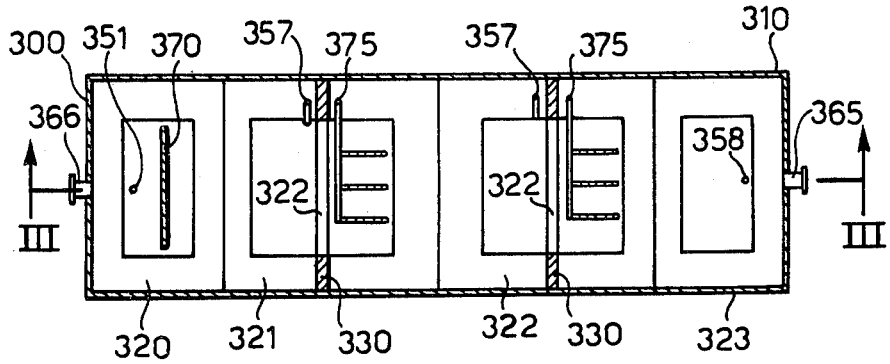
FIG. 4 is a cross-sectional view along the IV–IV line of FIG. 3.

In FIG. 3 a typical cell realized according to the present invention is depicted.

The cell 300 includes a tank 310 of mild steel, containing four containers 320, 321, 322, 323, constituted of siliceous refractory material, which are inserted and laid at the bottom.

The central containers 321 and 322 are square, while the lateral ones 320 and 323 are rectangular with dimensions half the central ones.

The central containers 321 and 322 have a groove 325 which permits the insertion of a vertical wall 330, also made of siliceous refractory material, which is held in place by the various lids 340, made of mild steel, which cover the tank 310.

Said walls 330 have, each of them, two rectangular openings 331 and 332, one in the central part (332) of the walls, and the other (331) in the lower part internal of the containers 321 and 322.

The containers 320, 321, 322 and 323 are filled with molten metal 350, which has a density higher than that of the electrolyte 360.

The tank 310 is filled with electrolyte 360 up to the openings 332 of the walls 330.

Above the lateral container 320 a titanium starting sheet 370 is introduced, which is connected to the negative terminal of the rectifier. On this sheet the codeposition of liquid metal and solid titanium occurs.

The liquid metal drops into the container 320, from which, by means of a pipe 351 and a pump 355, it is transferred to the inside of the other containers 321, 322 and 323, through metallic pipes 357 and 358, which are sheeted with refractory to secure electrical insulation.

The volatile compound of the reactive metal to be produced, which in the case of titanium is the tetrachloride, is fed by means of the mild steel pipes 375, which are bent and foraminated at their lower ends, in order to distribute said compound inside the containers 321 and 322 filled by molten metal 350.

Above the containers 321 and 322, into which the gaseous compound is insufflated, the pipes 377 are used for the recirculation of the gases which have not completely reacted, and thus bubble out of the electrolyte.

The extreme pipe 358 used for supplying the liquid metal is made of graphite and sheeted of refractory in order to electrically insulate only the portion of its length which passes through the body of the electrolyte; this pipe 358 is connected to the positive terminal of the rectifier, and is immersed into the container 323, which is filled with liquid metal 350, in order to allow a suitable electrical connection with the metal itself.

The circulation of the electrolyte 360 incoming to and exiting out of the cell occurs by means of pipes 365 and 366.

Above the lids 340 of the cell 300 is schematically depicted a suitable apparatus for feeding 376 and distributing the gaseous compound, and recycling 378 the gases coming out of the cell, and the liquid metal 352.

At the steady state condition the heating of the cell 300 is provided by the electrolysis current by Joule effect. At the start up, graphite electrodes (not shown) are lowered into the cell through openings in the lids and supplied with a-c current to heat and melt the electrolyte 360.

Figure 5:
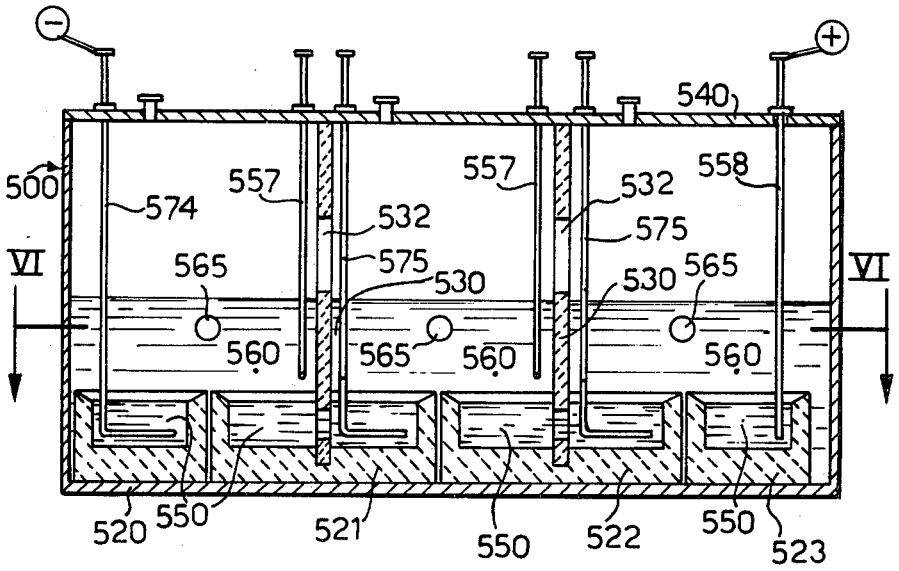
FIG. 5 is a cross-sectional view along the V—V line of FIG. 6, of an electrolytic cell in which, according to the invention, the cathodic dissolution of a liquid or gaseous compound of the metal to be produced, is operated.
Figure 6:
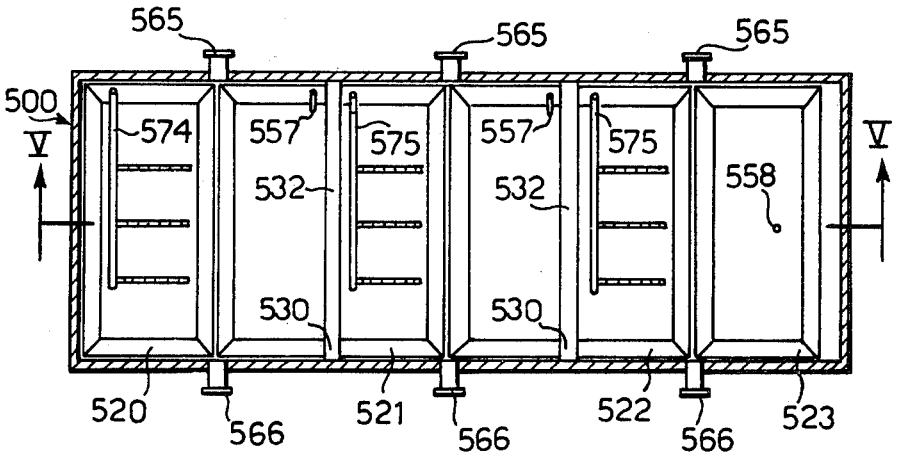
FIG. 6 is a cross-sectional view along the VI—VI line of FIG. 5.

FIG. 5 is a cross-sectional schematic view of an electrolytic cell 500 in which only the cathodic dissolution of the metal compound occurs; that is, neither the simultaneous electrodeposition of the metal to be produced nor the reduction of the HBE electrode metal occurs.

Inside containers 520, 521, and 522, analogously to FIG. 3, HBE are fed, through pipes 574 and 575, with the liquid or gaseous compound to be reduced and with the HBE electrode metal 550 through pipes 557 and 558. The openings 532 in the walls 530 are near the lids 540, above the electrolyte 560 level, with the purpose of circulating the atmosphere of the individual compartments, while the circulation of the electrolyte 560 incoming and exiting the cell occurs through pipes 565 and 566.

Figure 7:
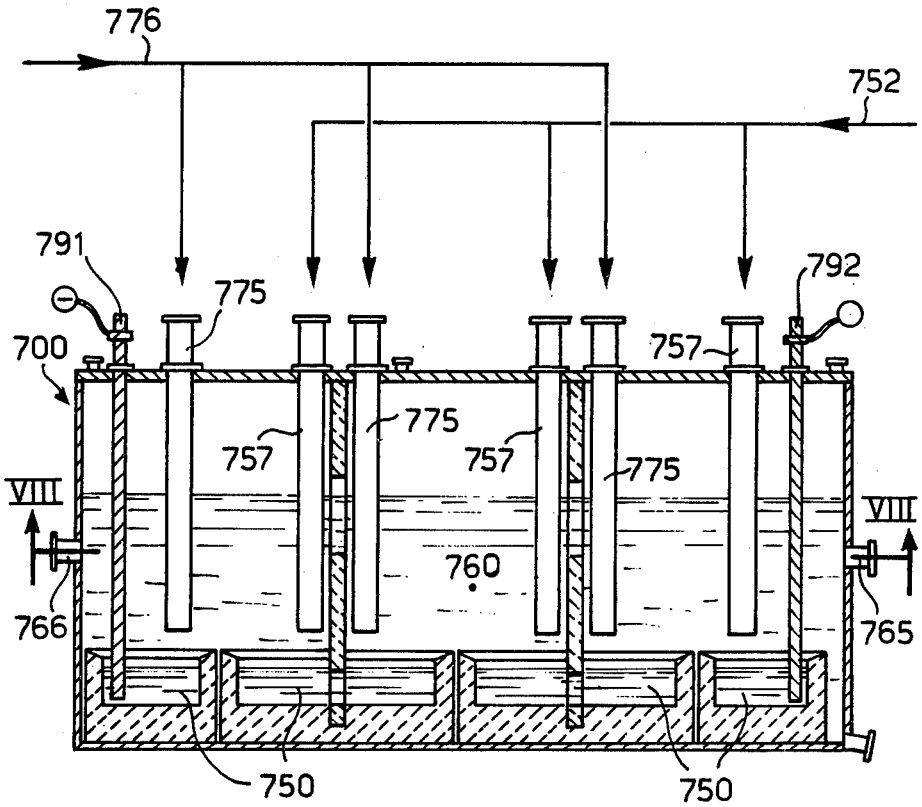
FIG. 7 is a cross-sectional view along the VII—VII line of FIG. 8, of an electrolytic cell in which, according to the invention, the cathodic dissolution of a solid compound of the metal to be produced is operated.
Figure 8:
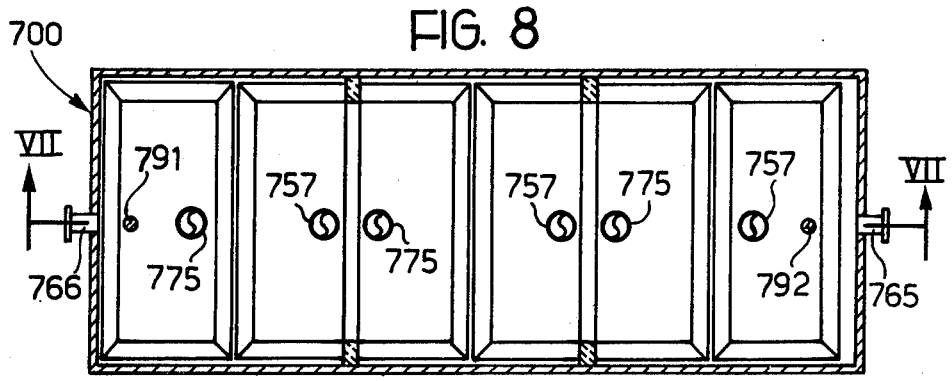
FIG. 8 is a cross-sectional view along the line VIII—VIII of FIG. 7.

In FIG. 7 is illustrated a cross-sectional schematic view of an electrolytic cell 700 for the cathodic dissolution of solid metal compounds, in which cell the function of the liquid HBE electrode metal 750 is only that of an electronic conductor; the anodic reaction involves part of the metal previously produced, as for example metallic titanium in form of dendrites, powder or metal fragments, including scrap, which is supplied through the feeding system 752 and pipes 757, in a continuous mode inside the cell.

The metal compound is introduced onto the cathodic faces of the HBE with a inert gas flux 776 through pipes 775.

The pipes 765 and 766 permit the circulation of the electrolyte 760 incoming and exiting the cell 700.

The electric current is supplied to the cell by means of the graphite bars 791 and 792, which are sheeted with refractory in order to electrically insulate them from contacting the electrolyte.

Figure 9:
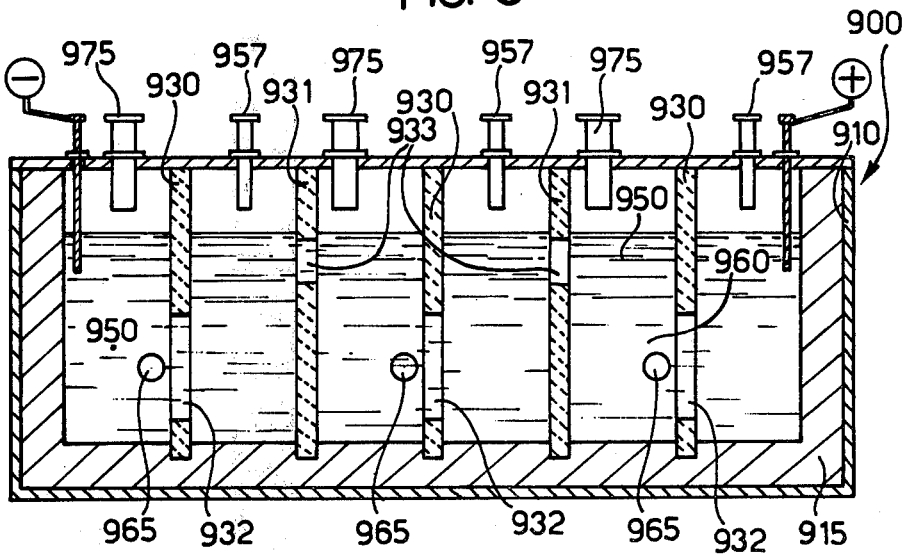
FIG. 9 is a cross-sectional view of an electrolytic cell in which, according to the invention, the cathodic dissolution of a solid compound takes place, when the liquid metal has a density lower than that of the electrolyte.

FIG. 9 is a schematic illustration of a cross-sectional view of an electrolytic cell 900 for the cathodic dissolution of solid compounds, as for example titanium dioxide, in which it is used, as HBE electrode metal 950, a metal which is lighter than the electrolyte 960, and thus floating on it; this electrode metal is also lighter than the metal compound.

Tank 910, made of mild steel, in the case of the use of an electrolyte composed of fluorides, is completely lined with refractories 915 apt to resist the corrosive action of the electrolyte.

Said tank is divided in sections by means of the refractory walls 930 and 931, having the wall 930 an opening 932 on their lower part in order to allow the ionic conduction of the electrolyte 960, and the wall 931 having another opening in the upper part 933, in order to use the electronic conduction of the HBE electrode metal 950 which floats over the electrolyte 960.

Titanium dioxide is supplied from above the liquid metal 950 by means of the feeding pipes 975 into the cathode zones of the HBE.

Above the cell, not shown, the distribution system for feeding the solid compound with an inert gas flux, and the liquid metal is placed.

The liquid metal is supplied by means of pipes 957.

Pipes 965 allow the circulation of the electrolyte incoming and exiting the cell 900, since in this embodiment it was preferred not to use the walls 931 with the electrolyte openings.

Figure 10:
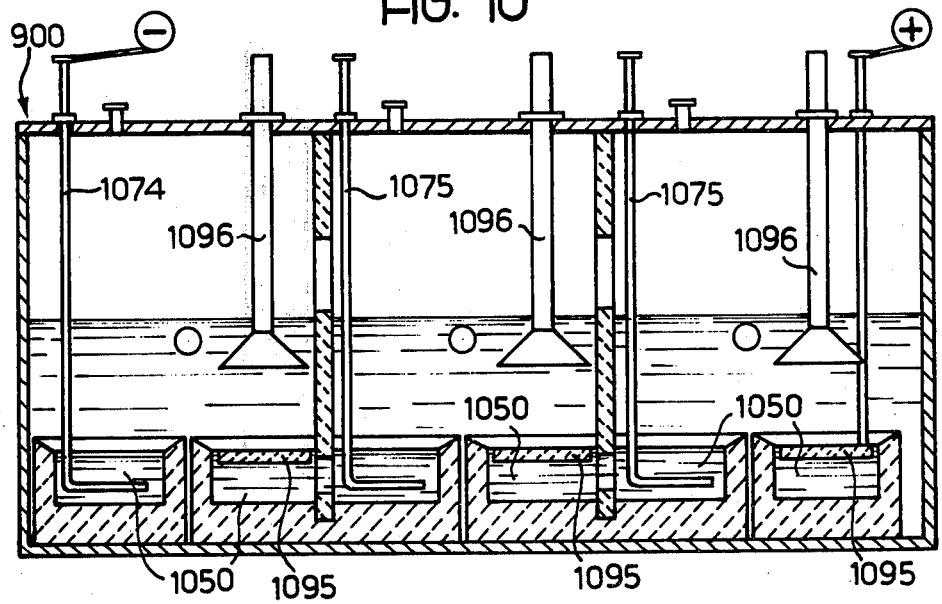
FIG. 10 is a cross-sectional view of an electrolytic cell in which, according to the invention, the cathodic dissolution of the compound of the metal to be produced occurs, when the anodic reaction in a gaseous evolution on an electrode floating on the liquid metal.

In FIG. 10 is schematically illustrated an electrolytic cell 1000 for the cathodic dissolution of compounds, in which the liquid metal 1050 has the function of electronic conductor, while the anodic reaction is a gaseous evolution which takes place over a solid electrode 1095 made of graphite and floating on the liquid metal, and this being electronically connected to it.

In FIG. 10 the cell is supplied with a liquid or gaseous compound by means of the pipe 1074 and 1075; in order to use a solid compound a different feeding system is required.

The evolving gases, e.g. oxygen, chlorine, sulphur and others, are funnelled in the electrically insulated hoods 1096 and conducted out of the cell.

Figure 11:
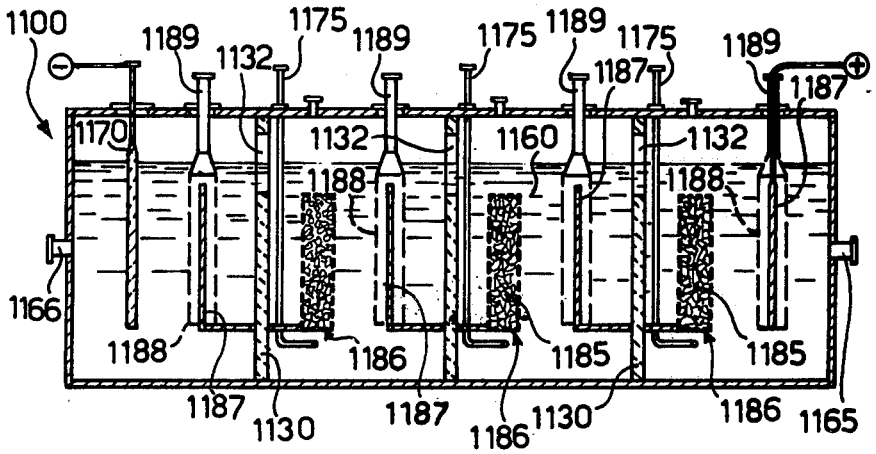
FIG. 11 is a cross-sectional view of a cell for the cathodic dissolution of the compound and simultaneous metal electrowinning when the anodic reaction is a gaseous evolution and the function of the auxiliary metal is carried by a solid electronic conductor.

In FIG. 11 is schematically illustrated an electrolytic cell 1100 for the dissolution and simultaneous electrowinning of the cathode 1170, in which cell the HBE are composed, on the cathodic side, of a packed bed 1185 of graphite, which is contained in a basket 1186 also made of graphite; the anodic side of the HBE is constituted by a graphite plate 1187 enclosed within a metal grid 1188.

The two sides of the HBE are separated by a wall 1130 made of insulating refractories, having an opening 1132 to allow the flow of the electrolyte 1160.

The compound to be reduced, in liquid or gaseous form, is supplied from below the basket 1186 by means of a bent, foraminous pipe 1175, while on the electrode 1187 the evolving gases are conducted out of the cell 1100 through the hoods 1189.

Another geometrical configuration, similar to that indicated in FIG. 11, comprises an other graphite basket, instead of the plate electrode for the gaseous evolution.

The metal is fed into the anodic basket in form of dendrites, fragments or scrap while the solid compound, is introduced into the cathodic basket.

Figure 12:
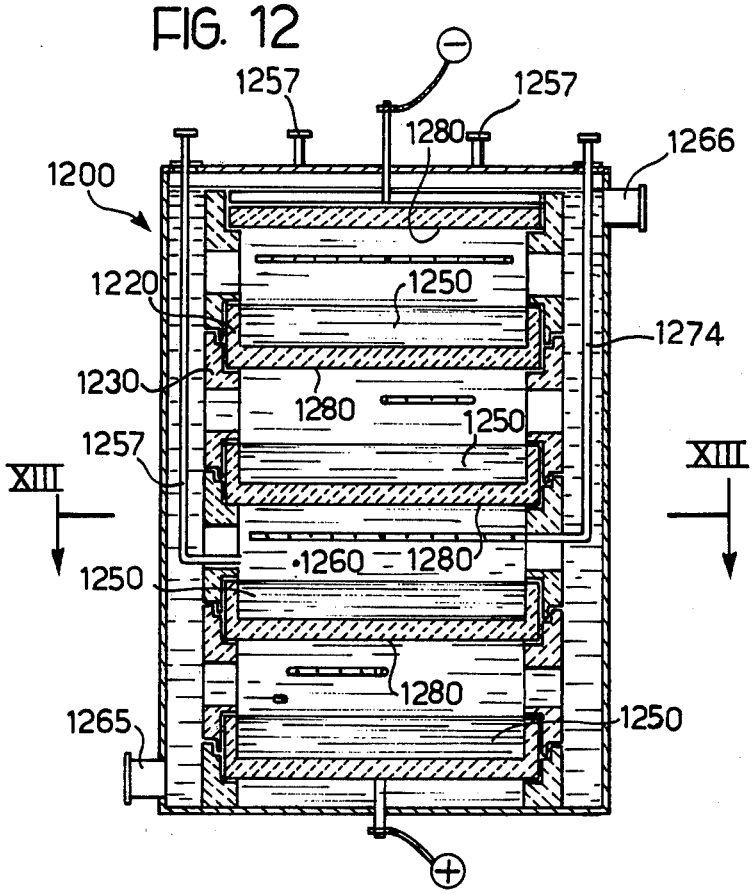
FIG. 12 is a cross-sectional view along the XII—XII line of FIG. 13 of a cell made up of a pile of horizontal heterogeneous bipolar electrodes.
Figure 13:
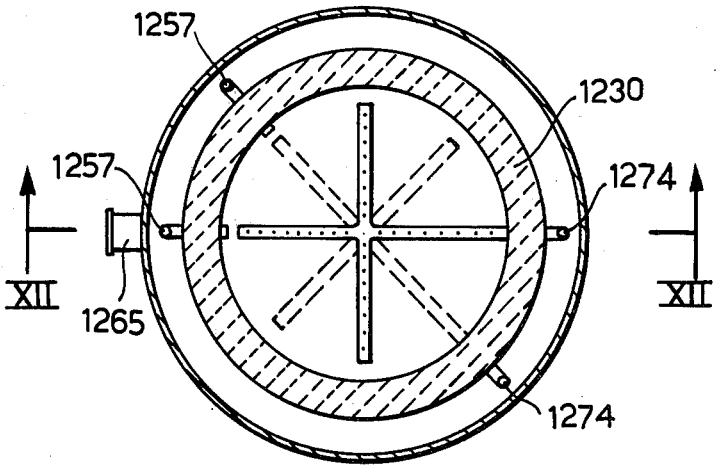
FIG. 13 depicts a cross-sectional view along the XIII—XIII line of the pile of FIG. 12.

In FIG. 12 an horizontal geometric configuration for an electrolytic cell 1200 of HBE is depicted as composed by a pile of round containers; these containers are made of graphite in the form of a dish 1220, fabricated in such a way that the rims 1230, made of refractory material, can be inserted around its edge.

The refractories are electrical insulators and also serve as spacers for the HBE.

The liquid metal 1250 is held in the graphite dish 1220 on the upper side of the container. The cathodic reduction and dissolution of the compound occurs at the bottom 1280 of the container; the compound in gaseous or liquid form is supplied by independent pipes 1274 at each HBE; pipes 1257 supply the liquid metal to the containers. The electrolyte 1260 flow, enters the cell through the pipe 1265 and goes out of the cell through pipe 1266.

Figure 14:
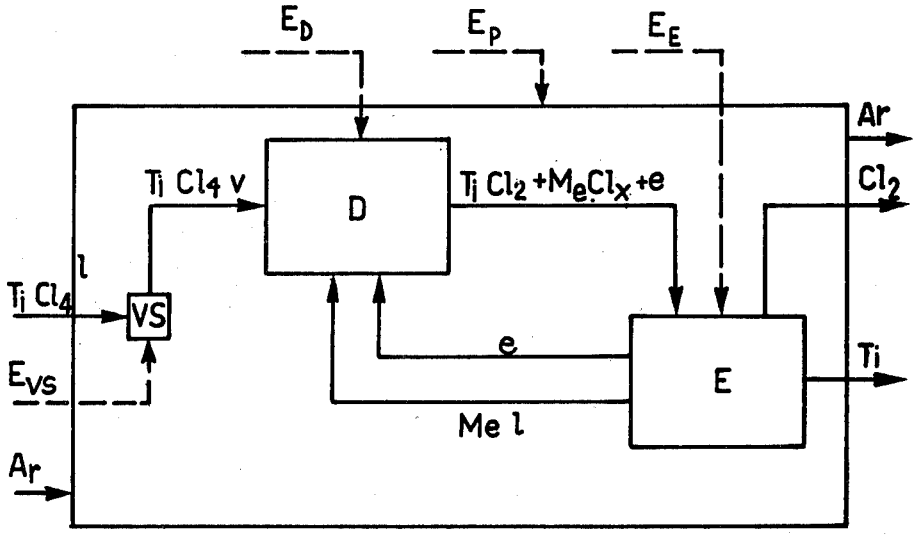
FIG. 14 illustrates a simplified flow diagram of a plant for the production of electrolytic titanium according to the invention.

In FIG. 14 is schematically illustrated a simplified flow diagram of material and energy for an industrial plant for the production of electrolytic titanium, which uses liquid metal and titanium tetrachloride as a raw material.

The plant is essentially composed of:

the dissolution cell "D", of the type indicated in FIG. 5, in which vaporized and superheated titanium tetrachloride is supplied at the operative temperature.

the electrowinning cell "E", in which is carried out the codeposition of titanium and HBE electrode metal, with evolution of gaseous chlorine.

The dissolution cell has the purpose of cathodically reducing Ti (IV) to Ti (II) which is soluble, while the anodic reaction involves the HBE electrode metal; in the extraction cell the cathodic codeposition of the two metals, solid Ti and liquid HBE electrode metal, takes place.

In the drawing, the continuous lines indicate material flow, while the dashed lines indicate flows of energy.

The symbol meanings are the following:

$E_{VS}$—energy for vaporizing and superheating $TiCl_4$
$E_D$—energy for electrolysis in the dissolution cells
$E_E$—energy for electrolysis in the winning cells
$E_P$—energy for ancillary equipments and heat losses.
I—liquid
v—vapour
Me—liquid HBE electrode metal
e—electrolyte
VS—vaporizer and super heater
D—electrolytic dissolution cell
E—electrowinning cell Three material flows occur between the two cells; they are: electrolyte circuit from cell D to cell E, the return circuit from E to D, and the HBE electrode metal flow from cell E to D.

With an electrolyte flow between the cells of about three-cell volume per hour, the difference in Ti concentration between the incoming and the exiting electrolyte is maintained about 10–15%.

The chlorine produced in reclaimed.

All the operations are preferably carried out under a controlled atmosphere, in which the partial pressures of oxygen, nitrogen and water vapour are maintained at the lowest practical values; thus applicant's plant was built into a chamber isolated from the outside ambient.

EXAMPLE 1

Continuous production of electrolytic titanium in a plant according to the flow diagram outlined in FIG. 14, by means of the dissolution electrolytic cell shown in FIG. 5, by using titanium tetrachloride as raw material and lead as the HBE electrode metal.

Operational data:
Titanium production: 4.16 kg/hr
Tetrachloride feeding: 16.65 kg/hr
Electrolyte rate: 610 kg/hr
Electrolyte mean temperature: 775° C.
Electrolyte chemistry exiting the dissolution cell (% by weight):
NaCl 69.9%
$TiCl_x$ 26.0% (Ti 10.5%)
$PbCl_2$ 4.1%
Ti average valence 2.05
Dissolution cell:
Voltage 2.2 V
Current 1618 A Winning cell:
Voltage 4.5 V
Current 10354 A

EXAMPLE 2

Continuous production of electrolytic titanium in a plant according to the flow diagram outlined in FIG. 14, by means of the dissolution cell shown in FIG. 9, by using titanium dioxide as raw material ($TiO_2$ contained ≧98%) and a lithium-sodium alloy as the HBE electrode liquid metal.

Operational data:
Titanium production: 3.13 kg/hr
Dioxide feeding: 5.44 kg/hr
Electrolyte rate: 1130 kg/hr
Electrolyte mean temperature: 725° C.
Electrolyte chemistry exiting the dissolution cell (% by weight):
Soluble Titanium (as $Ti^{+++}$) 2.3%
Lithium and Sodium Fluorides (50% eutectic)
Dissolution cell:
Voltage: 2.9 V
Current: 649 A
Winning cell:
Voltage: 5.0 V
Current: 7790 A

I claim:

1. In a process for producing a metal or metalloid from compounds thereof using an electrolytic cell comprising a terminal anode, a terminal cathode and an electrolyte extending therebetween wherein said compounds are solubilized in said electrolyte by direct current reduction in electron conductive contact with said terminal cathode, the improvement comprising:

(a) providing in said cell between said terminal anode and cathode a plurality of heterogenous bipolar electrodes, each of said heterogenous bipolar electrodes having an anodic portion and a cathodic portion comprised of metal or a mixture of metals;

(b) feeding said compounds of metal or metalloid to said cell into electronic contact with said cathodic portion of said heteronenous bipolar electrodes electrodes while passing electric current through the cell to simultaneously produce direct cathodic reduction of said compounds on said cathodic portions and liberating metal, or metalloid ions, of lower valence than the metal or metalloid of said compounds into said electrolyte from said anodic portions;

(c) circulating said electrolyte in a closed circuit including said bipolar electrodes, said terminal cathode and said terminal anode; and (d) depositing said liberated ionic metal or metaloid on said terminal cathode.

2. The process of claim 1, further comprising an electrowinning cell in said closed circuit wherein said metal or metalloid is electrolytically separated.

3. The process of claim 2, wherein said anodic and cathodic portions comprise a metal different from the metal to be deposited.

4. The process of claim 2, wherein said anodic and cathodic portions comprise a metal or mixture of metals the same as the metal being deposited.

5. The process of claim 2, wherein said metal or mixture of metals of said anodic and cathodic portion are heavier or lighter than the electrolyte.

6. The process of claim 5, wherein the temperature of the electrolyte is lower than the melting point of the metal or metalloid to be produced, and the metal or metalloid is separated in the electrowinning cell as solid deposit accompanied by a portion of said metal of said anodic and cathodic portions in liquid condition and the thus separated metal is collected in liquid state and recirculated to the electrolytic cell and collects as a pool therein.

7. The process of claim 6, wherein said electrolyte is a fused salt bath at elevated temperature and said metal or metal mixture of said anodic and cathodic portions is in molten condition at said elevated temperature.

8. The process of claim 7, wherein an amount of the metal or metalloid to be produced is deposited in solid state on the cathode of the electrolytic cell together with an amount of said metal of said anodic and cathodic portions in liquid condition and the thus separated metal is collected in its liquid condition to form a pool associated with the cathode from which it is recirculated to said heterogenous bipolar electrodes defined by bipolar pools.

9. The process of claim 8, wherein said pool defines said cathodic portion and the compound to be solubilized is fed also to this pool thereby to cathodically solubilize the compound.

10. The process of claim 2, wherein the electrolyte is an aqueous solution.

11. The process of claim 2, wherein said compound to be solubilized is titanium tetrachloride and the metal of said anodic and cathodic portions is lead.

12. The process of claim 2, wherein said insoluble compound is titanium dioxide and the metal mixture of said anodic and cathodic portions is a lithium/sodium alloy.

13. The process of claim 2, wherein said electrolyte is a non aqueous solution.

14. The process of claim 2, wherein said compound to be solutilized is titanium tetrachloride.

15. The process of claim 2, wherein said compound to be solubilized is zirconium tetrachloride.

16. The process of claim 2, wherein said compound to be solubilized is titanium dioxide.

17. The process of claim 2, wherein said compound to be solubilized is zirconium dioxide.

18. The process of claim 2, wherein said metal or metalloid to be produced is selected from the group of boron, sulfur, arsenic and silicon.

19. The process of claim 2, wherein said metal or metalloid to be produced are base metals selected from the group lead, copper tin, and zinc.

20. The process of claim 2, wherein said metal or metalloid to be produced are reactive metals selected from the group titanium, zirconium, hafnium, tantalum, niobium, vanadium, chromium, molybdenum, tungsten, silicon and aluminum.

21. The process of claim 2, wherein said metal or metalloid to be produced are ferrous metals and ferroalloys selected from the group iron, manganese, nickel, cobalt, vanadium, silicon and chromium.

22. The process of claim 2, wherein said metal or metalloid to be produced are minor metals selected from the group bismuth, antimony, cadmium, beryllium, and rare-earth metals.

23. The process of claim 2, wherein the heterogeneous bipolar electrodes are solid and made as a structure formed by the metal of the anodic and cathodic portions onto which a paste of the compound of the metal to be produced is spread and pressed.

24. The process of claim 2, wherein said metal or metalloid to be produced is a transition metal.

* * * * *